US011417280B2

(12) United States Patent
Wang

(10) Patent No.: US 11,417,280 B2
(45) Date of Patent: Aug. 16, 2022

(54) PIXEL CIRCUIT AND DRIVING METHOD THEREFOR, AND DISPLAY SUBSTRATE AND DISPLAY DEVICE

(71) Applicants: ORDOS YUANSHENG OPTOELECTRONICS CO., LTD., Inner Mongolia (CN); BOE TECHNOLOGY GROUP CO., LTD., Beijing (CN)

(72) Inventor: Zhichong Wang, Beijing (CN)

(73) Assignees: ORDOS YUANSHENG OPTOELECTRONICS CO., LTD., Inner Mongolia (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 17/256,184

(22) PCT Filed: Feb. 4, 2020

(86) PCT No.: PCT/CN2020/074292
§ 371 (c)(1),
(2) Date: Dec. 25, 2020

(87) PCT Pub. No.: WO2020/192278
PCT Pub. Date: Oct. 1, 2020

(65) Prior Publication Data

US 2021/0264862 A1 Aug. 26, 2021

(30) Foreign Application Priority Data

Mar. 27, 2019 (CN) ..... 201910239897.6

(51) Int. Cl.
*G09G 3/3275* (2016.01)

(52) U.S. Cl.
CPC ... *G09G 3/3275* (2013.01); *G09G 2320/0257* (2013.01); *G09G 2330/02* (2013.01)

(58) Field of Classification Search
CPC ..... G09G 3/3275; G09G 2320/0257; G09G 2320/02; G09G 2300/0439–0465
See application file for complete search history.

(56) References Cited

U.S. PATENT DOCUMENTS

2016/0321994 A1* 11/2016 Lee ..... G09G 3/3258
2018/0047337 A1 2/2018 Zhu et al.
(Continued)

FOREIGN PATENT DOCUMENTS

CN 106910468 A 6/2017
CN 108154844 A 6/2018
CN 109801592 A 5/2019

OTHER PUBLICATIONS

First office action of Chinese application No. 201910239897.6 dated Apr. 1, 2020.
(Continued)

*Primary Examiner* — Stephen G Sherman
(74) *Attorney, Agent, or Firm* — Fay Sharpe LLP

(57) ABSTRACT

A pixel circuit and a driving method therefor, and a display substrate and a display device are disclosed. The pixel circuit includes a compensation circuit. The compensation circuit may output an initial power supply signal to a first node, and a driving circuit may drive a light-emitting element to emit light according to a potential of the first node and a second power supply signal provided by a second power supply end. And, each driving circuit which the display panel includes may start to work from the same bias situation and drive the corresponding light-emitting element to emit light.

20 Claims, 7 Drawing Sheets

(56) References Cited

U.S. PATENT DOCUMENTS

| | | | | |
|---|---|---|---|---|
| 2018/0151113 | A1* | 5/2018 | Moon | G09G 3/3258 |
| 2018/0158410 | A1 | 6/2018 | Jeon | |

OTHER PUBLICATIONS

Second office action of Chinese application No. 201910239897.6 dated Sep. 21, 2020.
Notification to grant patent right for invention of Chinese application No. 201910239897.6 dated Dec. 17, 2020.

* cited by examiner

PIXEL CIRCUIT AND DRIVING METHOD THEREFOR, AND DISPLAY SUBSTRATE AND DISPLAY DEVICE

This present disclosure is a 371 of PCT Patent Application Serial No. PCT/CN2020/074292, filed on Feb. 4, 2020, which claims priority to Chinese Patent Application No. 201910239897.6, filed on Wednesday, Mar. 27, 2019, and entitled "PIXEL CIRCUIT AND DRIVING METHOD THEREFOR, AND DISPLAY SUBSTRATE AND DISPLAY DEVICE", the entire contents of which are incorporated herein by reference.

TECHNICAL FIELD

The present disclosure relates to the field of display technology, and more particularly to a pixel circuit and a driving method therefor, a display substrate and a display device.

BACKGROUND

The organic light emitting diode (OLED) is applied to high-performance display panels due to its characteristics of self-luminescence, fast response, wide viewing angle, and the like.

In the related art, the OLED display panel includes pixel units arranged in an array, each pixel unit including: a switching transistor, a driving transistor and an OLED. The switching transistor may output a data voltage provided by a data signal end to the driving transistor; and the driving transistor may convert the data voltage into a driving current and output the driving current to the OLED so as to drive the OLED to emit light.

SUMMARY

The present disclosure provides a pixel circuit and a driving method therefor, a display substrate and a display device.

In one aspect, a pixel circuit is provided. The pixel circuit includes: a light-emitting control circuit, a compensation circuit and a driving circuit; wherein the light-emitting control circuit is respectively coupled with a first gate signal end, a data signal end, a light-emitting control signal end, a first power supply end, a first node, a second node and a light-emitting element, and the light-emitting control circuit is used to control a potential of the first node and control switching-on and switching-off between the second node and the light-emitting element in response to a first gate driving signal from the first gate signal end, a data signal from the data signal end, a light-emitting control signal from the light-emitting control signal end and a first power supply signal from the first power supply end;

the compensation circuit is respectively coupled with the first gate signal end, a second gate signal end, a third gate signal end, an initial power supply end, the first node and the second node, and the compensation circuit is used to output an initial power supply signal provided by the initial power supply end in response to the first gate driving signal and a second gate driving signal from the second gate signal end, and adjust the potential of the first node in response to the first gate driving signal and a third gate driving signal from the third gate signal end and according to a potential of the second node; and the driving circuit is respectively coupled with the first node, a second power supply end and the second node, and the driving circuit is used to output a driving signal to the second node in response to the potential of the first node and a second power supply signal from the second power supply end.

Optionally, the compensation circuit includes: a first compensation sub-circuit and a second compensation sub-circuit; wherein the first compensation sub-circuit is respectively coupled with the second gate signal end, the third gate signal end, the initial power supply end, the second node and a third node, and the first compensation sub-circuit is used to output the initial power supply signal to the third node in response to the second gate driving signal, and control switching-on and switching-off between the second node and the third node in response to the third gate driving signal; and the second compensation sub-circuit is respectively coupled with the first gate signal end, the third node and the first node, and the second compensation sub-circuit is used to control switching-on and switching-off between the third node and the first node in response to the first gate driving signal.

Optionally, the first compensation sub-circuit includes: a first compensation transistor and a second compensation transistor; wherein a gate of the first compensation transistor is coupled with the second gate signal end, a first electrode of the first transistor is coupled with an initial power supply end, and a second electrode of the first compensation transistor is coupled with the third node; and a gate of the second compensation transistor is coupled with the third gate signal end, a first electrode of the second compensation transistor is coupled with the second node, and a second electrode of the second compensation transistor is coupled with the third node.

Optionally, the second compensation sub-circuit includes: a third compensation transistor; wherein a gate of the third compensation transistor is coupled with the first gate signal end, a first electrode of the third compensation transistor is coupled with the third node, and a second electrode of the third compensation transistor is coupled with the first node.

Optionally, the driving circuit includes: a driving transistor; wherein a gate of the driving transistor is coupled with the first node, a first electrode of the driving transistor is coupled with the second power supply end, and a second electrode of the driving transistor is coupled with the second node.

Optionally, the light-emitting control circuit includes: a data writing sub-circuit, a light-emitting control sub-circuit and a storage sub-circuit; wherein the data writing sub-circuit is respectively coupled with the first gate signal end, the data signal end and a fourth node, and the data writing sub-circuit is used to output the data signal to the fourth node in response to the first gate driving signal;

the light-emitting control sub-circuit is respectively coupled with the light-emitting control signal end, the first power supply end, the fourth node, the second node and the light-emitting element, and the light-emitting control sub-circuit is used to output the first power supply signal to the fourth node, and control switching-on and switching-off between the second node and the light-emitting element in response to the light-emitting control signal; and the storage sub-circuit is respectively coupled with the fourth node and the first node, and the storage sub-circuit is used to adjust the potential of the first node according to a potential of the fourth node.

Optionally, the data writing sub-circuit includes: a data writing transistor; the light-emitting control sub-circuit includes: a first light-emitting control transistor and a second light-emitting control transistor; the storage sub-circuit includes: a storage capacitor;

a gate of the data writing transistor is coupled with the first gate signal end, a first electrode of the data writing transistor is coupled with the data signal end, and a second electrode of the data writing transistor is coupled with the fourth node;

a gate of the first light-emitting control transistor is coupled with the light-emitting control signal end, a first electrode of the first light-emitting control transistor is coupled with the first power supply end, and a second electrode of the first light-emitting control transistor is coupled with the fourth node; and a gate of the second light-emitting control transistor is coupled with the light-emitting control signal end, a first electrode of the second light-emitting control transistor is coupled with the second node, and a second electrode of the second light-emitting control transistor is coupled with the light-emitting element;

one end of the storage capacitor is coupled with the fourth node, and the other end of the storage capacitor is coupled with the first node.

Optionally, all transistors which the pixel circuit includes are P-type transistors.

Optionally, the first power supply end is a reference power supply end, and the second power supply end is a light-emitting direct-current power supply end.

Optionally, the first power supply end and the second power supply end are light-emitting direct-current power supply ends.

In another aspect, a method for driving a pixel circuit is provided. The method is applied to the pixel circuit as defined in the foregoing aspect, and the method includes:

during an initialization phase, a potential of a first gate driving signal provided by a first gate signal end and a potential of a second gate driving signal provided by a second gate signal end being first potentials, outputting, by a compensation circuit, an initial power supply signal provided by an initial power supply end to a first node in response to the first gate driving signal and the second gate driving signal, wherein a potential of the initial power supply signal is the first potential;

during a data writing phase, the potential of the second gate driving signal being a second potential, the potential of the first gate driving signal and a potential of a third gate driving signal provided by a third gate signal being the first potentials, adjusting, by the compensation circuit, a potential of the first node according to a potential of the second node in response to the first gate driving signal and the third gate driving signal, and adjusting, by a light-emitting control circuit, the potential of the first node in response to the first gate driving signal and a data signal provided by a data signal end; and during a light-emitting phase, the potential of the first gate driving signal being the second potential, a potential of a light-emitting control signal provided by a light-emitting control end being the first potential, controlling, by the light-emitting control circuit, the potential of the first node in response to the light-emitting control signal and a first power supply signal provided by a first power supply end, and controlling, by the light-emitting control circuit, switching-on between the second node and a light-emitting element, and outputting, by a driving circuit, a driving signal to the second node in response to the potential of the first node and a second power supply signal provided by a second power supply end.

Optionally, the first potential is a low potential relative to the second potential.

Optionally, a duty cycle of the first gate driving signal, a duty cycle of the second gate driving signal and a duty cycle of the third gate driving signal are all the same as a duty cycle of the light-emitting control signal.

In still another aspect, a display substrate is provided. The display panel includes: a plurality of pixel units, wherein in the plurality of pixel units, at least one pixel unit includes: a light-emitting element and the pixel circuit, which is coupled with the light-emitting element, according to foregoing aspects.

Optionally, in the plurality of pixel units, each pixel unit includes: the light-emitting element and the pixel circuit, which is coupled with the light-emitting element, as according to foregoing aspects.

Optionally, the display substrate further includes: a gate driving circuit and a phase inverter; wherein a second gate signal end, a first gate signal end and a third gate signal end of the pixel circuit are respectively coupled with three adjacent output ends of the gate driving circuit; and the output end, coupled with the first gate signal end, of the gate driving circuit is further coupled with a light-emitting control signal end of the pixel circuit through the phase inverter.

Optionally, the number of the phase inverters which the display substrate includes and the number of the output ends which the gate driving circuit includes are both as same as the row number of the pixel units;

wherein each output end of the gate driving circuit is coupled with the light-emitting control signal end of the pixel circuit of one row of pixel units through one phase inverter.

In still another aspect, a display device is provided. The display device includes: a source driving circuit and the display substrate, as defined in the foregoing aspect, connected to the source driving circuit.

BRIEF DESCRIPTION OF THE ACCOMPANYING DRAWINGS

DETAILED DESCRIPTION

For clearer descriptions of the objects, technical solutions, and advantages of the present disclosure, specific embodiments of the present disclosure are described hereinafter in detail with reference to the accompanying drawings.

Transistors adopted in all embodiments of the present disclosure may be thin film transistors or field-effect transistors or other devices with the same characteristics, and the transistors adopted in the embodiment of the present disclosure are mainly switching transistors according to the effect in the circuit. Sources and drains of the switching transistors adopted herein are symmetrical, so the sources and the drains may be interchanged. In the embodiment of the present disclosure, the source is called a first electrode and the drain is called a second electrode, or the drain may be called a first electrode and the source may be called a second electrode. According to the forms in the accompanying drawings, the intermediate end of the transistor is a gate, the signal input end is a source, and the signal output end is a drain. The switching transistor adopted in the embodiment of the present disclosure may be a P-type switching transistor. The P-type switching transistor is switched on when the gate is in a low level, and the P-type switching transistor is switched off when the gate is in a high level. In addition, a plurality of signals in each embodiment of the present disclosure correspond to a first potential and a second potential. The first potential and the second potential only represent that the potential of the signal has two states, and do not represent that the first potential or the second potential in the specification has a specific value.

Due to magnetic hysteresis effect of the driving transistor in the pixel circuit, a driving current output by each driving transistor in the pixel circuit may vary with different variation amplitudes along with a potential difference between its gate and source (namely a potential difference between a gate potential and a source potential) when a displayed picture is switched. Accordingly, the driving currents output by all the driving transistors within a short time are different after the displayed picture is switched into a target displayed picture, thereby resulting in part of the displayed picture before switching remains in the target display picture within a short time after the displayed picture is switched into the target display picture, that is, causing the problem of short-term afterimages and poor display effects of the display device.

Figure 1:
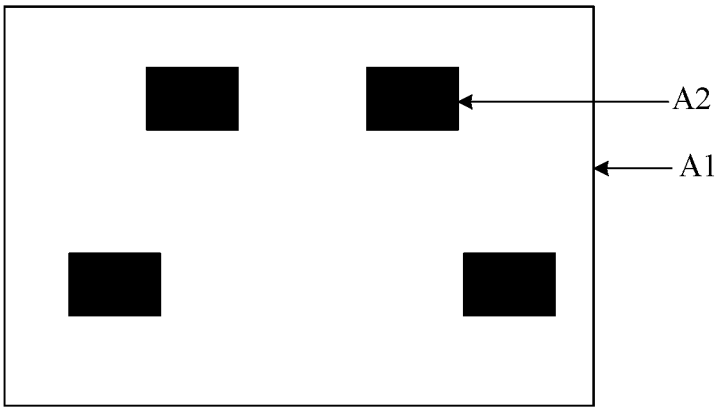
FIG. 1 is a schematic diagram that short-term afterimages appear on a display panel according to an embodiment of the present disclosure.

For example, supposing that a grayscale of each pixel unit in a to-be-switched target displayed picture is a target grayscale (such as 48 grayscale), a grayscale of one part of pixel unit in the displayed picture before switching is a first grayscale (such as 0), and a grayscale of the other part of pixel unit is a second grayscale (such as 255). Due to the magnetic hysteresis effect of the driving transistor, the change amplitude of the driving current output by the driving transistor along with the potential difference between its gate and source when the first grayscale is switched to the target grayscale may be different from the change amplitude of the driving current output by the driving transistor along with the potential difference between its gate and source along when the second grayscale is switched to the target grayscale. Accordingly, the driving currents output by all the driving transistors within a short time are different after the displayed picture is switched into the target displayed picture; thereby partial images of the displayed picture before switching remain in the target displayed picture within a short time. For example, referring to FIG. 1, four partial images A2 of the displayed picture before switching remain in the target display picture A1, and the display effect is poor.

Figure 2:
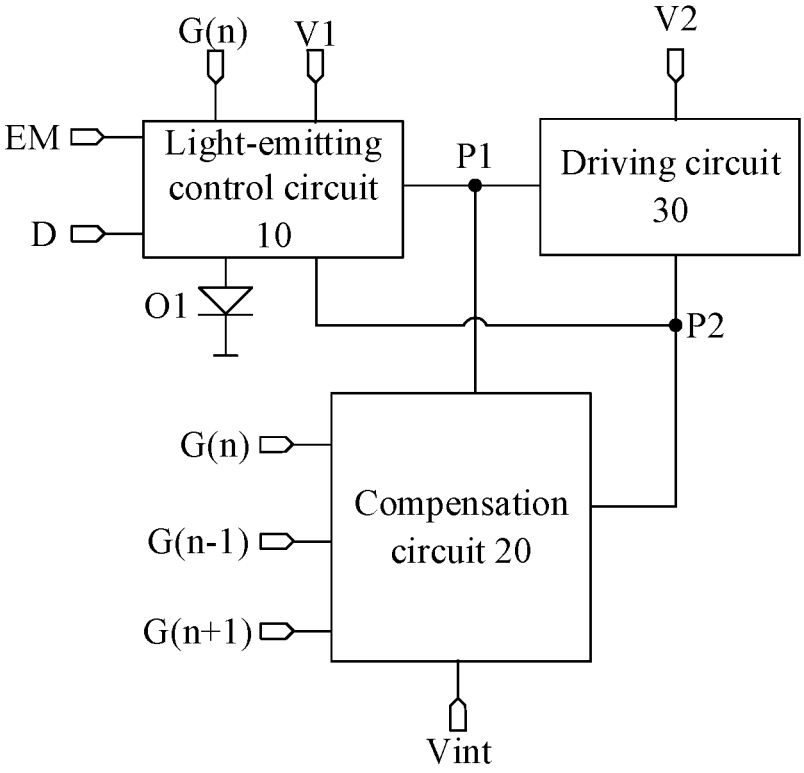
FIG. 2 is a schematic structural diagram of a pixel circuit according to an embodiment of the present disclosure.

The embodiment of the present disclosure provides a pixel circuit, which may solve the problem that short-term afterimages are likely to appear on the displayed picture. FIG. 2 is a schematic structural diagram of a pixel circuit according to an embodiment of the present disclosure. As shown in FIG. 2, the pixel circuit may include: a light-emitting control circuit 10, a compensation circuit 20 and a driving circuit 30.

The light-emitting control circuit 10 may be respectively coupled with a first gate signal end G(n), a data signal end D, a light-emitting control signal end EM, a first power supply end V1, a first node P1, a second node P2 and a light-emitting element 01. The light-emitting control circuit 10 may control a potential of the first node P1 in response to a first gate driving signal from the first gate signal end G(n), a data signal from the data signal end D, a light-emitting control signal from the light-emitting control signal end EM and a first power supply signal from the first power supply end V1, and control switching-on and switching-off between the second node P2 and the light-emitting element 01.

Coupling may include: electric connection between two ends or direct connection between two ends (for example, the two ends are connected by a signal line). The coupling modes between the two ends are not limited in the embodiment of the present disclosure.

For example, the light-emitting control circuit 10 may adjust the potential of the first node P1 according to the data signal provided by the data signal end D when the potential of the first gate driving signal provided by the first gate signal end G(n) is the first potential. The light-emitting control circuit 10 may further adjust the potential of the first node P1, and control switching-on between the second node P2 and the light-emitting element 01 according to the first power supply signal provided by the first power supply end V1 when the potential of the light-emitting control signal provided by the light-emitting control signal end is the first potential.

The compensation circuit 20 may be respectively coupled with the first gate signal end G(n), a second gate driving signal end G(n−1), a third gate signal end G(n+1), an initial power supply end Vint, the first node P1 and the second node P2. The compensation circuit 20 may output an initial power supply signal provided by the initial power supply end Vint to the first node P1 in response to the first gate driving signal and a second gate driving signal from the second gate signal end G(n−1), and may be used to adjust the potential of the first node P1 in response to the first gate driving signal and a third gate driving signal from the third gate signal end G(n+1) and according to the potential of the second node P2.

For example, the compensation circuit 20 may output the initial power supply signal provided by the initial power supply end Vint to the first node P1 when the potential of the first gate driving signal and the potential of the second gate driving signal provided by the second gate signal end G(n−1) are the first potential. Furthermore, the compensation circuit 20 may further adjust the potential of the first node P1 according to the potential of the second node P2 when the potential of the first gate driving signal and the potential of the third gate driving signal provided by the third gate signal end G(n+1) are the first potential. In the embodiment of the present disclosure, a potential of the initial power supply signal may be the first potential.

The driving circuit 30 may be respectively coupled with the first node P1, a second power supply end V2 and the second node P2. The driving circuit 30 may output a driving signal to the second node P2 in response to the potential of the first node P1 and a second power supply signal from the second power supply end V2.

For example, the driving circuit 30 may output the driving signal to the second node P2 according to the potential of the first node P1 and the second power supply signal provided by the second power supply end V2 when the potential of the first node P1 is the first potential. In the embodiment of the present disclosure, a potential of the second power supply signal may be a second potential, and the second potential may be a high potential relative to the first potential.

The compensation circuit 20 may output the initial power supply signal at the first potential to the first node P1, and the driving circuit 30 may output the driving signal to the second node P2 image according to potential of the first node P1 and the second power supply signal to drive the light-emitting element 01 to emit light. Therefore, when the displayed picture is switched, the driving circuit 30 in each pixel unit which the display panel includes may start to work from the same bias situation and drive the corresponding light-emitting element 01 to emit light to ensure the same change amplitude of the driving signal output by the driving circuit 30 in each pixel circuit, thereby improving the problem of short-term afterimages.

In summary, the embodiment of the present disclosure provides a pixel circuit, including a compensation circuit. The compensation circuit may output an initial power supply signal to a first node, and the driving circuit may drive a light-emitting element to emit light according to a potential of the first node and a second power supply signal provided by a second power supply end. Therefore, each driving circuit which the display panel includes may start to work from the same bias situation and drive the corresponding light-emitting element to emit light, thereby improving the problem that short-term afterimages are likely to appear on a displayed picture, and achieving good display effects.

Figure 3:
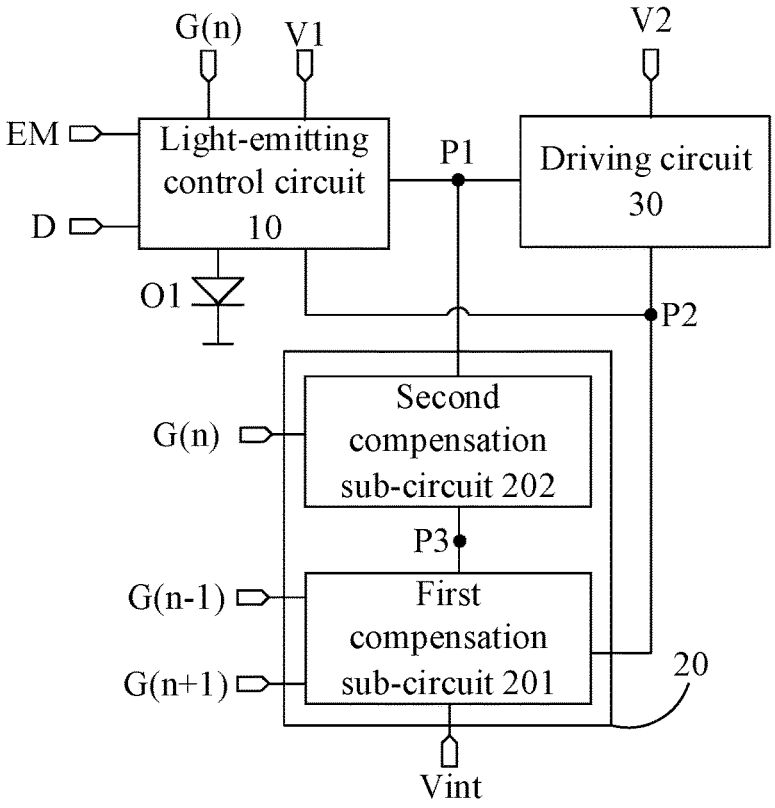
FIG. 3 is a schematic structural diagram of another pixel circuit according to an embodiment of the present disclosure.

FIG. 3 is a schematic structural diagram of another pixel circuit according to an embodiment of the present disclosure. As shown in FIG. 3, the compensation circuit 20 may include: a first compensation sub-circuit 201 and a second compensation sub-circuit 202.

The first compensation sub-circuit 201 may be respectively coupled with the second gate driving signal end G(n−1), the third gate signal end G(n+1), the initial power supply end Vint, the second node P2 and the third node P3. The first compensation sub-circuit 201 may output the initial power supply signal to the third node P3 in response to the second gate driving signal and may control switching-on and switching-off between the second node P2 and the third node P3 in response to the third gate driving signal.

For example, the first compensation sub-circuit 201 may output the initial power supply signal to the third node P3 when the potential of the second gate driving signal is the first potential. Moreover, the first compensation sub-circuit 201 may control switching-on between the second node P2 and the third node P3 when the potential of the third gate driving signal is the first potential, accordingly, the first compensation sub-circuit 201 may adjust the potential of the third node P3 according to the potential of the second node P2.

The second compensation sub-circuit 202 may be respectively coupled with the first gate signal end G(n), the third node P3 and the first node P1. The second compensation sub-circuit 202 may control switching-on and switching-off between the third node P3 and the first node P1 in response to the first gate driving signal.

For example, the second compensation sub-circuit 202 may control switching-on between the third node P3 and the first node P1 when the potential of the first gate driving signal is the first potential, accordingly, the second compensation sub-circuit 202 may adjust the potential of the first node P1 according to the potential of the third node P3.

Figure 4:
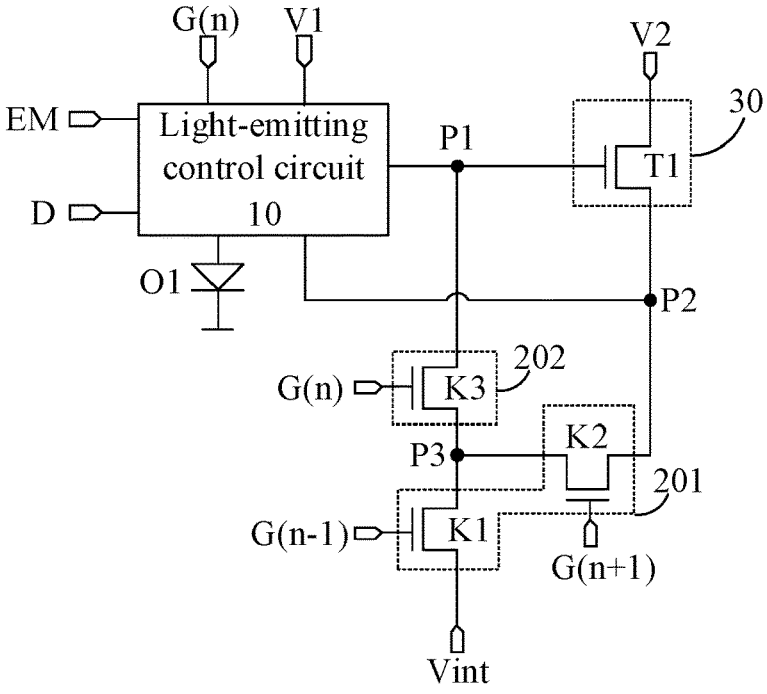
FIG. 4 is a schematic structural diagram of still another pixel circuit according to an embodiment of the present disclosure.

FIG. 4 is a schematic structural diagram of still another pixel circuit according to an embodiment of the present disclosure. As shown in FIG. 4, the first compensation sub-circuit 201 may include: a first compensation transistor K1 and a second compensation transistor K2.

A gate of the first compensation transistor K1 may be coupled with the second gate signal end G(n−1), a first electrode of the first compensation transistor K1 may be coupled with the initial power supply end Vint, and the second electrode of the first compensation transistor K1 may be coupled with the third node P3.

A gate of the second compensation transistor K2 may be coupled with the third gate signal end G(n+1), a first electrode of the second compensation transistor K2 may be coupled with the second node P2, and a second electrode of the second compensation transistor K2 may be coupled with the third node P3.

Optionally, referring to FIG. 4, the second compensation sub-circuit 202 may include: a third compensation transistor K3.

A gate of the third compensation transistor K3 may be coupled with the first gate signal end G(n), a first electrode of the third compensation transistor K3 may be coupled with the third node P3, and a second electrode of the third compensation transistor K3 may be coupled with the first node P1.

Optionally, referring to FIG. 4, the driving circuit 30 may include: a driving transistor T1.

A gate of the driving transistor T1 may be coupled with the first node P1, a first electrode of the driving transistor T1 may be coupled with the second power supply end V2, and a second electrode of the driving transistor T1 may be coupled with the second node P2.

The first compensation transistor K1 may output the initial power supply signal at the first potential to the third node P3 when the potential of the second gate driving signal is the first potential, and the third compensation transistor K3 may control switching-on between the third node P3 and the first node P1 when the potential of the first gate driving signal is the first potential; thereby the third compensation transistor K3 may write the initial power supply signal into the first node P1.

In addition, as the gate of the driving transistor T1 is coupled with the first node P1 and the second electrode is coupled with the second power supply end V2, supposing that the potential of the initial power supply signal is Vint0 and the potential of the second power supply signal is V20, then the potential Vg of the gate of the driving transistor T1 is Vint0 and the potential Vs of the source of the driving transistor T1 is V20 after the third compensation transistor K3 writes the initial power supply signal into the first node P1, and the potential difference Vgs between the gate and the source of the driving transistor T1 may meet: Vgs=Vg−Vs=Vint0−V20 before data of each frame of picture is written.

The potential difference Vgs between the gate and the source of the driving transistor T1 meets: Vgs=Vg−Vs=Vint0−V20 by writing the initial power supply signal into the gate of the driving transistor T1, which may ensure that when the displayed picture of the target grayscale is switched, the driving transistor T1 in each pixel circuit which the display panel includes may start to work from the same bias situation and drive the corresponding light-emitting element 01 to emit light, thereby improving the problem of short-term afterimages.

Figure 5:
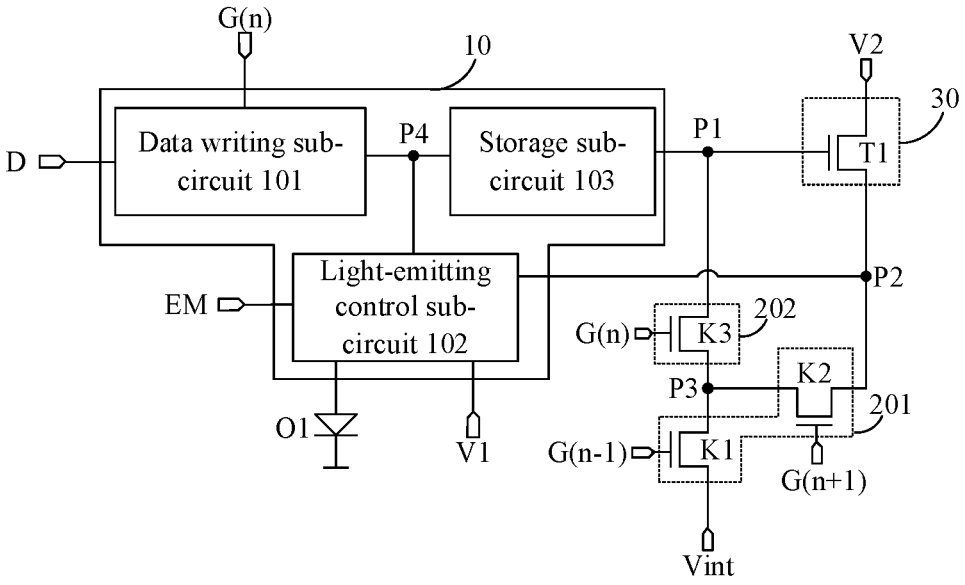
FIG. 5 is a schematic structural diagram of still another pixel circuit according to an embodiment of the present disclosure.

FIG. 5 is a schematic structural diagram of still another pixel circuit according to an embodiment of the present disclosure. As shown in FIG. 5, the light-emitting control circuit 10 may include: a data writing sub-circuit 101, a light-emitting control sub-circuit 102 and a storage sub-circuit 103.

The data writing sub-circuit 101 may be respectively coupled with the first gate signal end G(n), the data signal end D and the third node P4. The data writing sub-circuit 101 may output a data signal to the fourth node P4 in response to the first gate driving signal.

For example, the data writing sub-circuit 101 may output the data signal to the fourth node P4 when the potential of the first gate driving signal is the first potential.

The light-emitting control sub-circuit 102 may be respectively coupled with the light-emitting control signal end EM, the first power supply end V1, the first node P4, the second node P2 and the light-emitting element 01. The emitting control sub-circuit 102 may output a first power supply signal to the fourth node P4 and may control switching-on and switching-off between the second node P2 and the light-emitting element 01 in response to the light-emitting control signal.

For example, the light-emitting control sub-circuit 102 may output the first power supply signal to the fourth node P4 and control switching-on between the second node P2 and the light-emitting element 01 when the potential of the light-emitting control signal is the first potential.

The storage sub-circuit 103 may be respectively coupled with the fourth node P4 and the first node P1. The storage sub-circuit 103 may adjust the potential of the first node P1 according to the potential of the fourth node P4.

Figure 6:
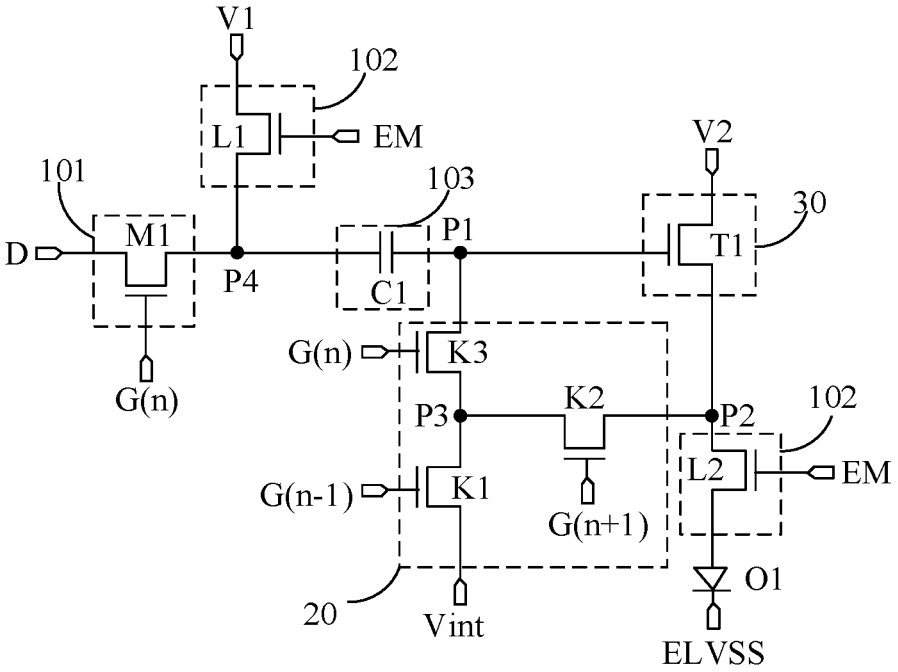
FIG. 6 is a schematic structural diagram of still another pixel circuit according to an embodiment of the present disclosure.

FIG. 6 is a schematic structural diagram of still another pixel circuit according to an embodiment of the present disclosure. As shown in FIG. 6, the data writing sub-circuit 101 may include: a data writing transistor M1. The light-emitting control sub-circuit 102 may include: a first light-emitting control transistor L1 and a second light-emitting control transistor L2. The storage sub-circuit 103 may include: a storage capacitor C1.

A gate of the data writing transistor M1 may be coupled with the first gate signal end G(n), a first electrode of the data writing transistor M1 may be coupled with the data signal end D, and a second electrode of the data writing transistor M1 may be coupled with the fourth node P4.

A gate of the first light-emitting control transistor L1 may be coupled with the light-emitting control signal end EM, a first electrode of the first light-emitting control transistor L1 may be coupled with the first power supply end V1, and a second electrode of the first light-emitting control transistor L1 may be coupled with the fourth node P4.

A gate of the second light-emitting control transistor L2 may be coupled with the light-emitting control signal end EM, a first electrode of the second light-emitting control transistor L2 may be coupled with the second node P2, and a second electrode of the second light-emitting control transistor L2 may be coupled with the light-emitting element 01. Moreover, referring to FIG. 6, the light-emitting element 01 may further be coupled with a low-level power supply end ELVSS.

One end of the storage capacitor C1 may be coupled with the fourth node P4, and the other end of the storage capacitor C1 may be coupled with the first node P1.

Optionally, in the embodiment of the present disclosure, the first power supply end V1 may be a reference power supply end Vref, and the light second power supply end V2 may be a light-emitting direct-current power supply end ELVDD. Or the first power supply end V1 and the second power supply end V2 may be the same power supply end. For example, the first power supply end V1 and the second power supply end V2 may be the light-emitting direct-current power supply end ELVDD. The number of the signal ends to be set may be reduced by using the same power supply end, which is beneficial to realizing a narrow bezel.

It should be noted that the above embodiments illustrate by taking the case where each transistor in the pixel circuit is the P-type transistor and the first potential is a low potential relative to the second potential as an example. Each transistor in the pixel circuit may further adopt an N-type transistor. When each transistor adopts the N-type transistor, the first potential may be a high potential relative to the second potential.

In summary, the embodiment of the present disclosure provides a pixel circuit, including a compensation circuit. The compensation circuit may output an initial power supply signal to a first node, and the driving circuit may drive a light-emitting element to emit light according to a potential of the first node and a second power supply signal provided by a second power supply end. Therefore, each driving circuit which the display panel includes may start to work from the same bias situation and drive the corresponding light-emitting element to emit light, thereby improving the problem that short-term afterimages are likely to appear on a displayed picture, and achieving good display effects.

Figure 7:
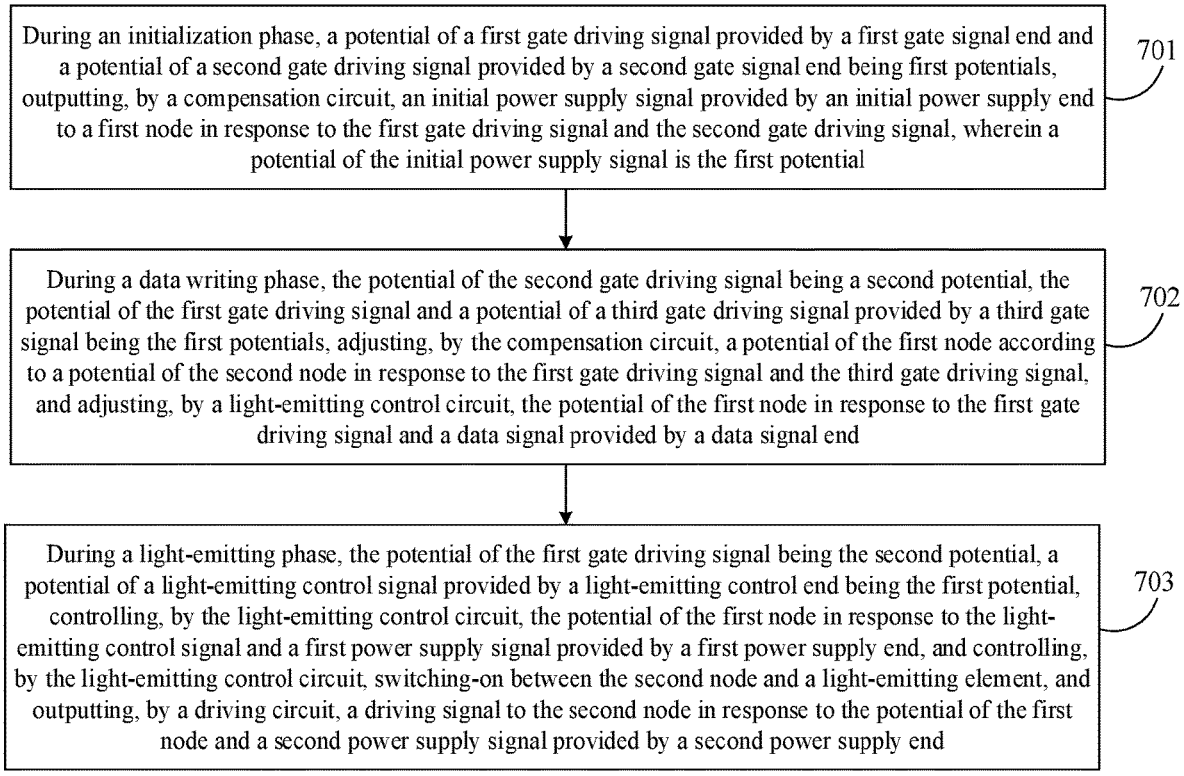
FIG. 7 is a flowchart of a method for driving a pixel circuit according to an embodiment of the present disclosure.

FIG. 7 is a flowchart of a method for driving a pixel circuit according to an embodiment of the present disclosure. The method may be applied to the pixel circuit shown in any one of FIG. 2 to FIG. 6. As shown in FIG. 7, the method may include:

In a step 701, during an initialization phase, a potential of a first gate driving signal provided by a first gate signal end and a potential of a second gate driving signal provided by a second gate signal end being first potentials, an initial power supply signal provided by an initial power supply end is output by a compensation circuit to a first node in response to the first gate driving signal and the second gate driving signal, wherein a potential of the initial power supply signal is the first potential.

In a step 702, during a data writing phase, the potential of the second gate driving signal being a second potential, the potential of the first gate driving signal and a potential of a third gate driving signal provided by a third gate signal being the first potentials, a potential of the first node is adjusted by the compensation circuit according to a potential of the second node in response to the first gate driving signal and the third gate driving signal, and the potential of the first node is adjusted by a light-emitting control circuit in response to the first gate driving signal and a data signal provided by a data signal end.

In a step 703, during a light-emitting phase, the potential of the first gate driving signal being the second potential, a potential of a light-emitting control signal provided by a light-emitting control end being the first potential, the potential of the first node is controlled by the light-emitting control circuit in response to the light-emitting control signal and a first power supply signal provided by a first power supply end, and switching-on between the second node and a light-emitting elements is controlled by the light-emitting control circuit, and a driving signal is output by a driving circuit to the second node in response to the potential of the first node and a second power supply signal provided by a second power supply end.

In summary, the embodiment of the present disclosure provides a method for driving a pixel circuit. As the compensation circuit may output the initial power supply signal to the first node in the initialization phase, and the driving circuit may drive the light-emitting element to emit light according to the potential of the first node and the second power supply signal provided by the second power supply end, each driving circuit which the display panel includes starts to work from the same bias situation and drives the corresponding light-emitting element to emit light, thereby improving the problem that short-term afterimages are likely to appear on a displayed picture, and achieving good display effects.

The driving principle of the pixel circuit according to the embodiment of the present disclosure is introduced in detail by taking the pixel circuit shown in FIG. 6 as an example and taking the transistors in the pixel circuit are the P-type transistors, the potential of the initial power supply signal provided by the initial power supply end Vint is the first potential, the potential of the second power supply signal provided by the second power supply end V2 is the second potential and the first potential is a low potential relative to the second potential as an example.

Figure 8:
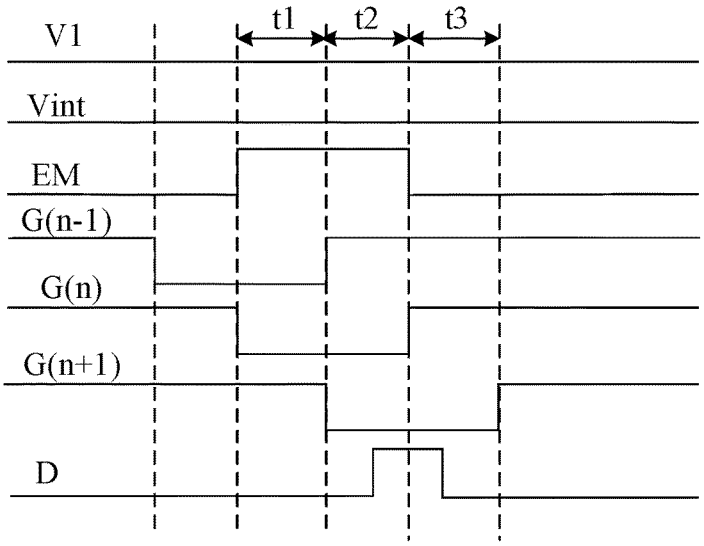
FIG. 8 is a time sequence diagram of signals of signal ends in a pixel circuit according to an embodiment of the present disclosure.

FIG. 8 is a sequence diagram of each signal end in a pixel circuit according to an embodiment of the disclosure. As shown in FIG. 8, in the initialization phase t1, a potential of a first gate driving signal provided by a first gate signal end G(n) and a potential of a second gate driving signal provided by a second gate signal end G(n−1) are the first potential. The data writing transistor M1, the first compensation transistor K1 and the third compensation transistor K3 are turned on. The initial power supply end Vint outputs the initial power supply signal at the first potential to the first node P1 by the first compensation transistor K1 and the third compensation transistor K3 to charge the first node P1, and the driving transistor T1 is turned on. The data signal end D outputs the data signal to the fourth node P4 by the data writing transistor M1.

Figure 9:
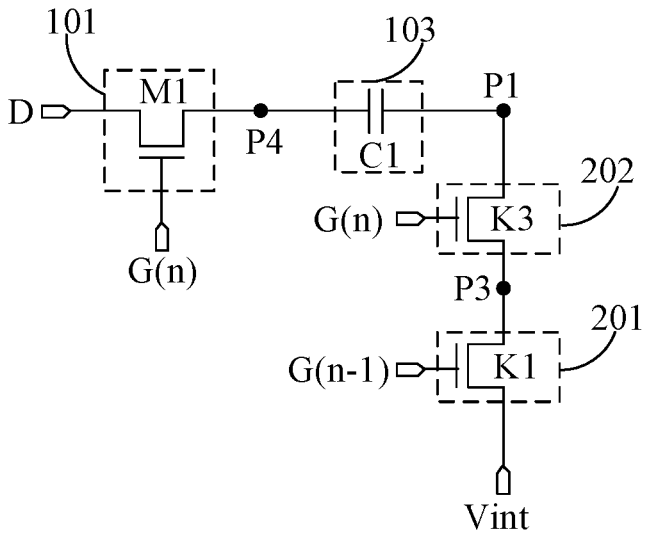
FIG. 9 is an equivalent circuit diagram of a pixel circuit at an initial phase according to an embodiment of the disclosure.

In addition, referring to FIG. 8, in the initialization phase t1, a potential of a third gate driving signal provided by the third gate driving signal end G(n+1) and a potential of a light-emitting control signal provided by the light-emitting control signal end EM are second potential. The second compensation transistor K2, the first light-emitting control transistor L1 and the second light-emitting control transistor L2 are turned off, and the light-emitting element 01 does not emit light. An equivalent circuit diagram of the pixel circuit in the initialization phase t1 may be referenced to FIG. 9.

The initial power supply end Vint may output the initial power supply signal at the first potential to the first node P1 by the first compensation transistor K1 and the third compensation transistor K3 in the initialization phase t1, and the gate of the driving transistor T1 is coupled with the first node P1 as well as the first electrode of the driving transistor T1 is coupled with the second power supply end V2; therefore, supposing that the potential of the initial power supply signal is Vint0 and the potential of the second power supply signal is V20, the potential difference Vgs between the gate and the source of the driving transistor T1 may meet: Vgs=Vint0−V20 before the driving transistor T1 starts to work in the initialization phase t1. The potential difference Vgs between the gate and the source of the driving transistor T1 meets: Vgs=Vint0−V20 by writing the initial power supply signal into the gate of the driving transistor T1, and thus each driving transistor T1 which the display panel includes may enter a data writing phase t2 and a light-emitting phase t3 from the same bias situation. That is, each driving transistor T1 may perform data writing under the same bias situation and drive the light-emitting element 01 to emit light, thereby improving the problem of short-term afterimages.

In the data writing phase t2, as shown in FIG. 8, the potential of the second gate driving signal is jumped into the second potential, the potential of the third gate driving signal is jumped into the first potential, and the potential of the first gate driving signal still maintains the first potential. The first compensation transistor K1 is turned off, the data writing transistor M1 and the third compensation transistor K3 still maintains a start situation, and the second compensation transistor K2 is turned on. The data signal end D continuously outputs the data signal to the fourth node P4 by the data writing transistor M1. In the initialization phase t1, the driving transistor T1 is turned on; therefore, in the data writing phase t2, the second power supply end V2 may continuously output the second power supply signal to the first node P1 by the driving transistor T1, the second compensation transistor K2 and the third compensation transistor K3 until the potential of the first node P1 is changed into V20+Vth, wherein Vth is a threshold voltage of the driving transistor T1.

Figure 10:
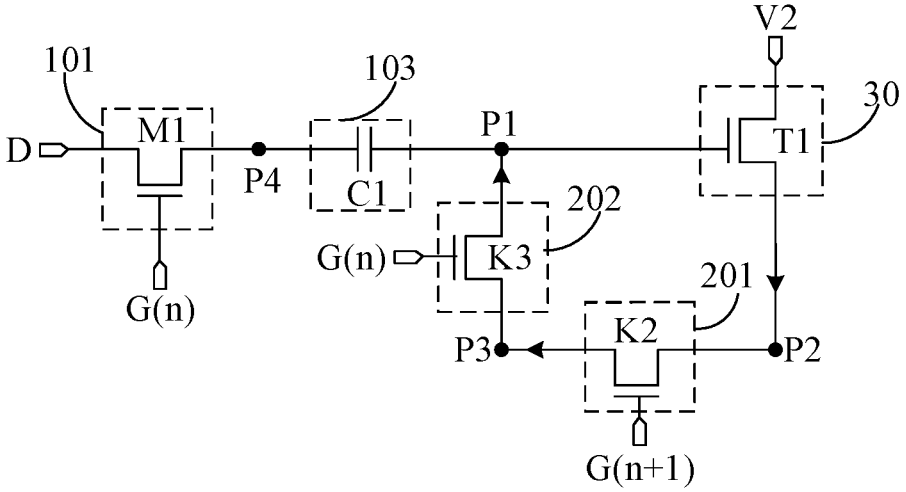
FIG. 10 is an equivalent circuit diagram of a pixel circuit at a data writing phase according to an embodiment of the disclosure.

In addition, referring to FIG. 8, in the data writing phase t2, the potential of the light-emitting control signal is still the second potential, accordingly, the first light-emitting control transistor L1 and the second light-emitting control transistor L2 still maintain to be turned off, and the light-emitting element 01 does not emit light. An equivalent circuit diagram of the pixel circuit in the data writing phase t2 may be referenced to FIG. 10.

Figure 11:
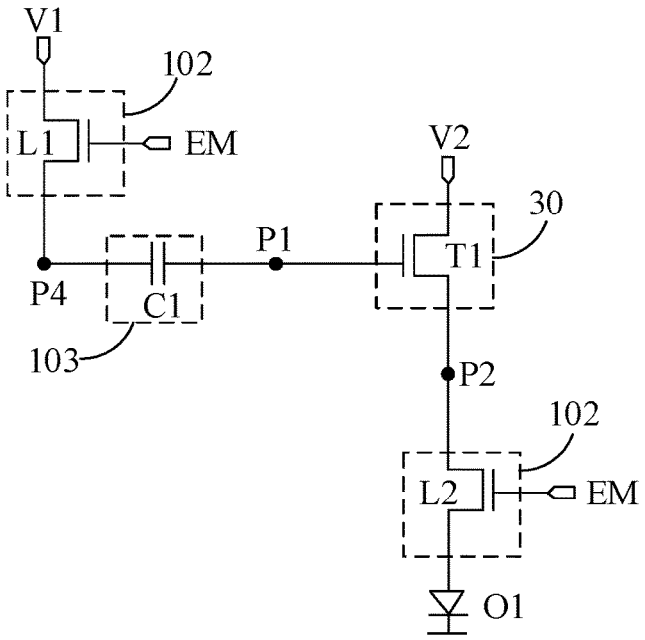
FIG. 11 is an equivalent circuit diagram of a pixel circuit at a light-emitting phase according to an embodiment of the disclosure.

In the light-emitting phase t3, the potential of the first gate driving signal is jumped into the second potential, the potential of the light-emitting control signal is jumped into the first potential, and the potential of the second gate driving signal is still the second potential. The data writing transistor M1, the first compensation transistor K1 and the third compensation transistor K3 are turned off, and the first light-emitting control transistor L1 and the second light-emitting control transistor L2 are turned on. The first power supply end V1 outputs the first power supply signal to the fourth node P4 by the first light-emitting control transistor L1. Supposing that a potential of the first power supply signal is V10, the potential of the fourth node P4 is changed into V10. If a potential of a data signal output to the fourth node P4 by the data signal end D in the data writing phase t2 is Vd, a potential variation of the fourth node P4 in the light-emitting phase t3 is V10−Vd. Furthermore, since the potential of the first node P1 is changed into V20+Vth in the data writing phase t2, the potential of the first node Pb is changed into V20+Vth+V10−Vd under the coupling action of the storage capacitor C1. That is, the potential of the gate of the driving transistor T1 in the light-emitting phase t3 is changed into V20+Vth+V10−Vd, and at this time, the driving transistor T1 is turned on. An equivalent circuit diagram of the pixel circuit in the light-emitting phase t3 may be referenced to FIG. 11.

Further, in the light-emitting phase t3, the driving transistor T1 may output a driving signal to the second node P2 according to the potential of the first node P1 and the second power supply signal. Moreover, the driving signal output to the second node P2 may be output to the light-emitting element 01 by the second light-emitting control transistor L2, thereby driving the light-emitting element 01 to emit light.

In the light-emitting phase t3, the potential Vg of the gate of the driving transistor T1 is changed into V20+Vth+V10−Vd, and the potential Vs of the source of the driving transistor T1 is V20, such that the potential difference between the gate and the source of the driving transistor T1 meets: Vgs=Vg−Vs=V20+Vth+V1−Vd−V20=Vth+V10−Vd.

The driving current $I_{OLED}$ generated by the driving transistor T1 may meet:

$$I_{OLED}=\tfrac{1}{2}K\times(Vgs-Vth)^2 \qquad \text{formula (1),}$$

Wherein K meets:

$$K=\frac{W}{L}\times C_{ox}\times\mu,$$

μ is a carrier mobility of the driving transistor T1, Cox is a capacitance of a gate insulating layer of the driving transistor T1, and W/L is a width-to-length ratio of the driving transistor T1.

The potential difference Vgs between the gate and the source is substituted into the above formula (1) to perform calculation to obtain the driving current $I_{OLED}$ output to the second node P2 by the driving transistor T1:

$$I_{OLED}=\tfrac{1}{2}K\times(Vgs-Vth)^2=\tfrac{1}{2}K\times(V10-Vd)^2 \qquad \text{formula (2).}$$

It should be noted that when the first power supply end V1 and the second power supply end V2 are the light-emitting direct-current power supply end ELVDD, the V10 is a direct-current power supply signal provided by the light-emitting direct-current power supply end ELVDD. Supposing that a potential of the direct-current power supply signal is Velvdd, then the driving current $I_{OLED}$ output to the second node P2 by the driving transistor T1 is:

$$I_{OLED}=\tfrac{1}{2}K\times(Vgs-Vth)^2=\tfrac{1}{2}K\times(\text{Velvdd}-Vd)^2.$$

When the first power supply end V1 is a reference power supply end Vref and the second power supply end V2 is the light-emitting direct-current power supply end ELVDD, the V10 is the reference power supply signal provided by the reference power supply end Vref and the potential of the reference power supply signal may be the first potential. Supposing that a potential of the reference power supply signal is Vref, the driving current $I_{OLED}$ output to the second node P2 by the driving transistor T1 is:

$$I_{OLED}=\tfrac{1}{2}K\times(Vgs-Vth)^2=\tfrac{1}{2}K\times(\text{Vref}-Vd)^2.$$

It can be seen from the above formula (2) that when the light-emitting element 01 works normally, a size of the driving current $I_{OLED}$ for driving the light-emitting element 01 is only related to the data signal provided by the data signal end D and the first power supply signal provided by the first power supply end V1, and is unrelated to the threshold voltage Vth of the driving transistor T1. Therefore, the threshold voltage Vth of the driving transistor T1 is compensated, the problem of non-uniform display brightness caused by shift of the Vth is avoided, and the uniformity of the display brightness of the display panel is ensured.

It should be noted that referring to FIG. 8, the potential of the second gate driving signal is the first potential before the initialization phase t1, but the potentials of the first gate driving signal, the light-emitting control signal and the third gate driving signal are the second potential, such that the normal work of the pixel is not affected.

Optionally, in the embodiment of the present disclosure, a duty cycle of the first gate driving signal provided by the first gate signal end, a duty cycle of the second gate driving signal provided by the second gate signal end and a duty cycle of the third gate driving signal provided by the third gate signal may be the same as a duty cycle of the light-emitting control signal provided by the light-emitting control signal end. Furthermore, a time sequence of the first gate driving signal may be complementary with a time sequence of the light-emitting control signal, that is the potential of the light-emitting control signal is the second potential when the potential of the first gate driving signal is the first potential; and the potential of the light-emitting control signal is the first potential when the potential of the first gate driving signal is the second potential.

In summary, the embodiment of the present disclosure provides a method for driving a pixel circuit. As the compensation circuit may output the initial power supply signal to the first node in the initialization phase, and may drive the light-emitting element to emit light according to the potential of the first node and the second power supply signal provided by the second power supply end in the light-emitting phase, each driving circuit which the display panel includes may start to work from the same bias situation and drive the corresponding light-emitting element to emit light, thereby improving the problem that short-term afterimages are likely to appear on a displayed picture, and achieving good display effects.

Figure 12:
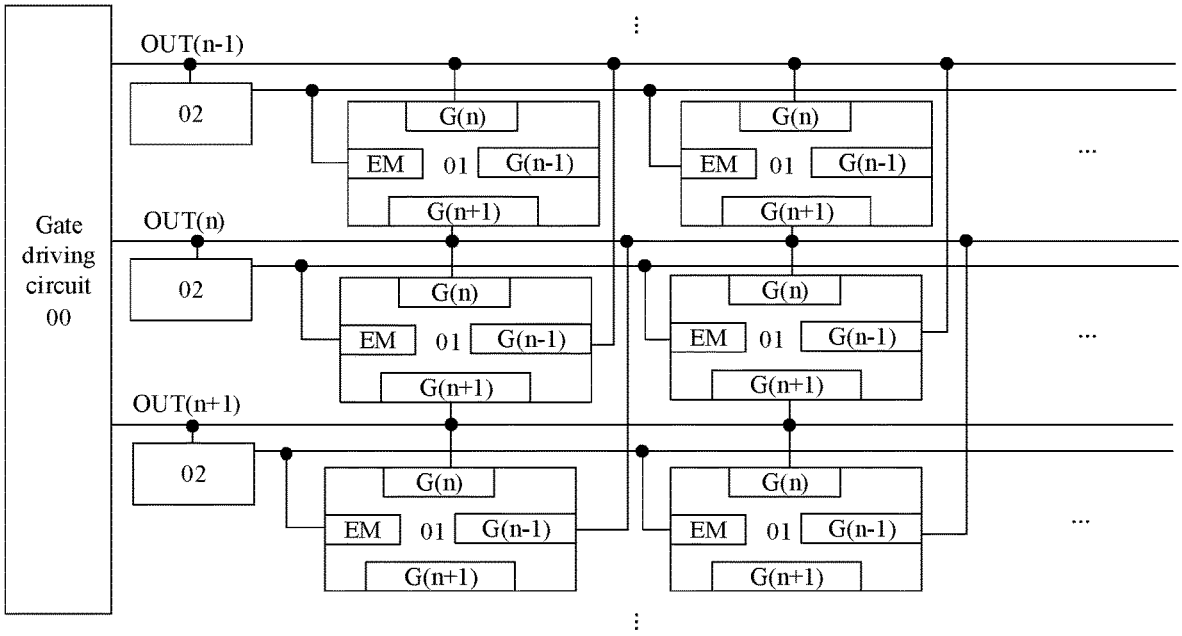
FIG. 12 is a schematic structural diagram of a display substrate according to an embodiment of the present disclosure.

FIG. 12 is a schematic structural diagram of a display substrate according to an embodiment of the present disclosure. As shown in FIG. 12, the display substrate may include: a plurality of pixel units. In the plurality of pixel units, at least one pixel unit may include: a light-emitting element (not shown in FIG. 12) and a pixel circuit 01 coupled with the light-emitting element and as shown in any one of FIG. 2 to FIG. 6. For example, in the plurality of pixel units, each pixel unit may include: a light-emitting element and a pixel circuit 01 coupled with the light-emitting element and as shown in any one of FIG. 2 to FIG. 6.

Optionally, the light-emitting element may be an OLED, that is the display substrate may be an OLED panel.

Optionally, referring to FIG. 12, the display substrate may further include: a gate driving circuit 00 and a phase inverter 02. The second gate signal end G(n−1), the first gate signal end G(n) and the third gate signal end G(n+1) of each pixel circuit 01 may be respectively coupled with three adjacent output ends of the gate driving circuit 00. Moreover, for each pixel circuit 01, the output end, coupled with the first gate signal end G(n) of the pixel circuit 01, in the gate driving circuit 00 may further be coupled with the light-emitting control signal end EM of the pixel circuit 01 through the phase inverter 02. Optionally, the phase inverters 02 may be integrated in the gate driving circuit 00.

In the embodiment of the present disclosure, as shown in FIG. 12, the number of the phase inverters 02 which the display substrate includes and the number of the output ends OUT which the gate driving circuit 00 includes may be equal to the row number of the pixel units 01 which the display substrate includes. Furthermore, each output end of the gate driving circuit 00 is coupled with the light-emitting control signal end of the pixel circuit of one row of pixel units 01 through one phase inverter 02.

For example, as shown in FIG. 12, for each pixel circuit 01 in the $n_{th}$ row, the first gate signal end G(n) may be coupled with an output end OUT(n) of the gate driving circuit 00, the second gate signal end G(n−1) may be coupled with an output end OUT(n−1) adjacent to the output end OUT(n) in the gate driving circuit 00, and the third output end G(n+1) may be coupled with another output end OUT(n+1) adjacent to the output end OUT(n) in the gate driving circuit 00. The output end OUT(n), coupled with the first gate signal G(n) of each pixel circuit 01 in the $n_{th}$ row, of the gate driving circuit 00 may further be coupled with the light-emitting control signal end EM of each pixel circuit 01 in the $n_{th}$ row by the same phase inverter 02.

Compared with the related art that the gate driving circuit is coupled with the gate signal end and the light-emitting control driving circuit is coupled with the light-emitting control signal, one output end of the gate driving circuit is coupled with the gate signal end and the light-emitting control signal end simultaneously, thereby reducing the number of components arranged in the display substrate and being beneficial to realizing a narrow bezel.

Figure 13:
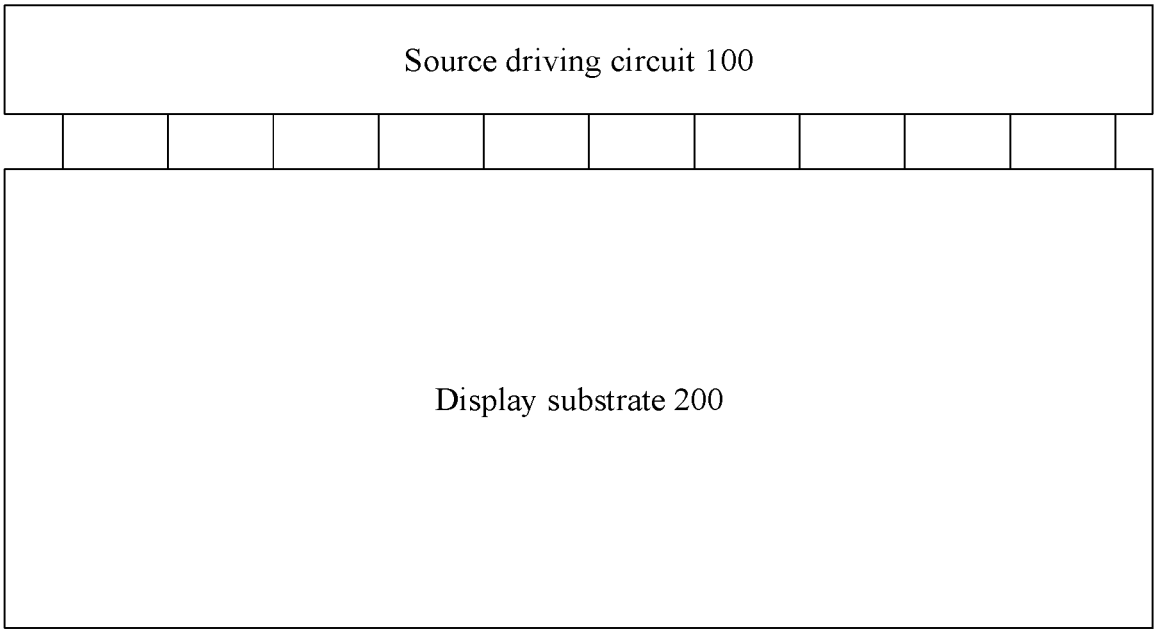
FIG. 13 is a schematic structural diagram of a display device according to an embodiment of the present disclosure.

In addition, as shown in FIG. 13, the embodiment of the present disclosure further provides a display device. The display device may include a source driving circuit 100 and the display substrate 200 provided by the above embodiments connected to the source driving circuit 100. For example, the display substrate 200 may be a display substrate shown in FIG. 12.

The source driving circuit 100 may be connected to the data signal end D of the pixel circuit of each pixel unit and is used to provide the data signal to the data signal end D of each pixel circuit.

Optionally, the display device may be: any products or parts with a display function, such as an OLED display device, an AMOLED display device, a mobile phone, a tablet computer, a television, a display, a notebook computer, a digital photo frame, a navigator, or the like.

It will be apparent to those skilled in the art that the specific operations of the described pixel circuit and each sub-circuit may be referenced to the corresponding process in the aforementioned method embodiments for the sake of convenience and conciseness of the description and will not be elaborated herein.

The above descriptions are merely optional embodiments of the present disclosure, and are not intended to limit the present disclosure. Within the spirit and principles of the present disclosure, any modifications, equivalent replacements, improvements, or the like, are within the protection scope of the present disclosure.

What is claimed is:

1. A pixel circuit, comprising: a light-emitting control circuit, a compensation circuit and a driving circuit; wherein the light-emitting control circuit is respectively coupled with a first gate signal end, a data signal end, a light-emitting control signal end, a first power supply end, a first node, a second node and a light-emitting element, and the light-emitting control circuit is used to control a potential of the first node, and control switching-on and switching-off between the second node and the light-emitting element in response to a first gate driving signal from the first gate signal end, a data signal from the data signal end, a light-emitting control signal from the light-emitting control signal end and a first power supply signal from the first power supply end;

the compensation circuit is respectively coupled with the first gate signal end, a second gate signal end, a third gate signal end, an initial power supply end, the first node and the second node, and the compensation circuit is used to output an initial power supply signal provided by the initial power supply end in response to the first gate driving signal and a second gate driving signal from the second gate signal end, and adjust the potential of the first node according to a potential of the second node in response to the first gate driving signal and a third gate driving signal from the third gate signal end;

the compensation circuit comprises: a first compensation sub-circuit and a second compensation sub-circuit; the first compensation sub-circuit is respectively coupled with the second gate signal end, the third gate signal end, the initial power supply end, the second node and a third node, and the first compensation sub-circuit is used to output the initial power supply signal to the third node in response to the second gate driving signal, and control switching-on and switching-off between the second node and the third node in response to the third gate driving signal; and the driving circuit is respectively coupled with the first node, a second power supply end and the second node, and the driving circuit is used to output a driving signal to the second node in response to the potential of the first node and a second power supply signal from the second power supply end.

2. The circuit according to of claim 1, wherein the second compensation sub-circuit is respectively coupled with the first gate signal end, the third node and the first node, and the second compensation sub-circuit is used to control switching-on and switching-off between the third node and the first node in response to the first gate driving signal.

3. The circuit according to claim 2, wherein the first compensation sub-circuit comprises: a first compensation transistor and a second compensation transistor; wherein a gate of the first compensation transistor is coupled with the second gate signal end, a first electrode of the first transistor is coupled with the initial power supply end, and a second electrode of the first compensation transistor is coupled with the third node; and a gate of the second compensation transistor is coupled with the third gate signal end, a first electrode of the second compensation transistor is coupled with the second node, and a second electrode of the second compensation transistor is coupled with the third node.

4. The circuit according to claim 2, wherein the second compensation sub-circuit comprises: a third compensation transistor; wherein a gate of the third compensation transistor is coupled with the first gate signal end, a first electrode of the third compensation transistor is coupled with the third node, and a second electrode of the third compensation transistor is coupled with the first node.

5. The circuit according to claim 1, wherein the driving circuit comprises: a driving transistor; wherein a gate of the driving transistor is coupled with the first node, a first electrode of the driving transistor is coupled with the second power supply end, and a second electrode of the driving transistor is coupled with the second node.

6. The circuit according to claim 1, wherein the light-emitting control circuit comprises: a data writing sub-circuit, a light-emitting control sub-circuit and a storage sub-circuit; wherein the data writing sub-circuit is respectively coupled with the first gate signal end, the data signal end and a fourth node, and the data writing sub-circuit is used to output the data signal to the fourth node in response to the first gate driving signal;

the light-emitting control sub-circuit is respectively coupled with the light-emitting control signal end, the first power supply end, the fourth node, the second node and the light-emitting element, and the light-emitting control sub-circuit is used to output the first power supply signal to the fourth node in response to the light-emitting control signal, and control switching-on and switching-off between the second node and the light-emitting element; and the storage sub-circuit is respectively coupled with the fourth node and the first node, and the storage sub-circuit is used to adjust the potential of the first node according to a potential of the fourth node.

7. The circuit according to claim 6, wherein the data writing sub-circuit comprises: a data writing transistor; wherein a gate of the data writing transistor is coupled with the first gate signal end, a first electrode of the data writing transistor is coupled with the data signal end, and a second electrode of the data writing transistor is coupled with the fourth node.

8. The circuit according to claim 6, wherein the light-emitting control sub-circuit comprises: a first light-emitting control transistor and a second light-emitting control transistor; wherein a gate of the first light-emitting control transistor is coupled with the light-emitting control signal end, a first electrode of the first light-emitting control transistor is coupled with the first power supply end, and a second electrode of the first light-emitting control transistor is coupled with the fourth node; and a gate of the second light-emitting control transistor is coupled with the light-emitting control signal end, a first electrode of the second light-emitting control transistor is coupled with the second node, and a second electrode of the second light-emitting control transistor is coupled with the light-emitting element.

9. The circuit according to claim 8, wherein all transistors which the pixel circuit comprise are P-type transistors.

10. The circuit according to claim 6, wherein the storage sub-circuit comprises: a storage capacitor; wherein one end of the storage capacitor is coupled with the fourth node, and the other end of the storage capacitor is coupled with the first node.

11. The circuit according to claim 1, wherein the first power supply end is a reference power supply end, and the second power supply end is a light-emitting direct-current power supply end.

12. The circuit according to claim 1, wherein the first power supply end and the second power supply end are light-emitting direct-current power supply ends.

13. A method for driving a pixel circuit, applied to the pixel circuit according to claim 1, wherein the method comprises:

during an initialization phase, a potential of the first gate driving signal provided by the first gate signal end and a potential of the second gate driving signal provided by the second gate signal end being first potentials, outputting, by the compensation circuit, the initial power supply signal provided by the initial power supply end to the first node in response to the first gate driving signal and the second gate driving signal, wherein a potential of the initial power supply signal is the first potential;

during a data writing phase, the potential of the second gate driving signal being a second potential, the potential of the first gate driving signal and a potential of the third gate driving signal provided by the third gate signal being the first potentials, adjusting, by the compensation circuit, a potential of the first node according to a potential of the second node in response to the first gate driving signal and the third gate driving signal, and adjusting, by the light-emitting control circuit, the potential of the first node in response to the first gate driving signal and the data signal provided by the data signal end; and during a light-emitting phase, the potential of the first gate driving signal being the second potential, a potential of the light-emitting control signal provided by the light-emitting control end being the first potential, controlling, by the light-emitting control circuit, the potential of the first node in response to the light-emitting control signal and the first power supply signal provided by the first power supply end, and controlling, by the light-emitting control circuit, switching-on between the second node and the light-emitting element, and outputting, by the driving circuit, the driving signal to the second node in response to the potential of the first node and the second power supply signal provided by the second power supply end.

14. The method according to claim 13, wherein the first potential is a low potential relative to the second potential.

15. The method according to claim 13, wherein a duty cycle of the first gate driving signal, a duty cycle of the second gate driving signal and a duty cycle of the third gate driving signal are all the same as a duty cycle of the light-emitting control signal.

16. A display substrate, comprising: a plurality of pixel units, wherein among the plurality of pixel units, at least one pixel unit comprises: a light-emitting element and a pixel circuit coupled with the light-emitting element, wherein the pixel circuit comprises: a light-emitting control circuit, a compensation circuit and a driving circuit; wherein the light-emitting control circuit is respectively coupled with a first gate signal end, a data signal end, a light-emitting control signal end, a first power supply end, a first node, a second node and a light-emitting element, and the light-emitting control circuit is used to control a potential of the first node, and control switching-on and switching-off between the second node and the light-emitting element in response to a first gate driving signal from the first gate signal end, a data signal from the data signal end, a light-emitting control signal from the light-emitting control signal end and a first power supply signal from the first power supply end;

the compensation circuit is respectively coupled with the first gate signal end, a second gate signal end, a third gate signal end, an initial power supply end, the first node and the second node, and the compensation circuit is used to output an initial power supply signal provided by the initial power supply end in response to the first gate driving signal and a second gate driving signal from the second gate signal end, and adjust the potential of the first node according to a potential of the second node in response to the first gate driving signal and a third gate driving signal from the third gate signal end;

the compensation circuit comprises: a first compensation sub-circuit and a second compensation sub-circuit; the first compensation sub-circuit is respectively coupled with the second gate signal end, the third gate signal end, the initial power supply end, the second node and a third node, and the first compensation sub-circuit is used to output the initial power supply signal to the third node in response to the second gate driving signal, and control switching-on and switching-off between the second node and the third node in response to the third gate driving signal; and the driving circuit is respectively coupled with the first node, a second power supply end and the second node, and the driving circuit is used to output a driving signal to the second node in response to the potential of the first node and a second power supply signal from the second power supply end.

17. The display substrate according to claim 16, wherein among the plurality of pixel units, each pixel unit comprises: the light-emitting element and the pixel circuit coupled with the light-emitting element.

18. The display substrate according to claim 16, wherein the display substrate further comprising: a gate driving circuit and a phase inverter; wherein a second gate signal end, a first gate signal end and a third gate signal end of the pixel circuit are respectively coupled with three adjacent output ends of the gate driving circuit; and the output end, coupled with the first gate signal end, of the gate driving circuit is further coupled with a light-emitting control signal end of the pixel circuit through the phase inverter.

19. The display substrate according to claim 18, wherein the number of phase inverters which the display substrate comprises and the number of the output end which the gate driving circuit comprises are both as same as the number of rows of the pixel units;

wherein each output end of the gate driving circuit is coupled with the light-emitting control signal end of the pixel circuit of one row of pixel units through one phase inverter.

20. A display device, comprising a source driving circuit and the display substrate, which is connected to the source driving circuit, according to claim 16.

* * * * *